US006141860A

United States Patent [19]

Shimahara

[11] Patent Number: 6,141,860

[45] Date of Patent: Nov. 7, 2000

[54] METHOD FOR MANUFACTURING COIL

[76] Inventor: Shiro Shimahara, 2619-5, Ooaza Ueda, Ueda-shi, Nagano-ken, 386-1102, Japan

[21] Appl. No.: 09/271,277

[22] Filed: Mar. 17, 1999

[51] Int. Cl.[7] ..... H01F 41/02

[52] U.S. Cl. ..... 29/605; 72/136

[58] Field of Search ..... 29/605; 72/136, 72/137

[56] References Cited

FOREIGN PATENT DOCUMENTS

| | | | |
|---|---|---|---|
| 52-139955 | 11/1977 | Japan . | |
| 5510380 | 1/1980 | Japan | 72/136 |
| 5-768222 | 4/1982 | Japan . | |
| 370109 | 3/1991 | Japan . | |

*Primary Examiner*—Carl E. Hall

*Attorney, Agent, or Firm*—Birch, Stewart, Kolasch & Birch, LLP

[57] ABSTRACT

A method for manufacturing a coil is composed of the step of rolling a conductor of trapezoidal cross section or a conductor of rectangular cross section in the longitudinal direction thereof. An amount of deformation is gradually increased from a side of the conductor corresponding to the inner side of the coil toward a side of the conductor corresponding to the outer side of the coil. As a result, the conductor of trapezoidal cross section is formed into a coiled conductor of rectangular cross section, or the conductor of rectangular cross section is formed into a coiled conductor of trapezoidal cross section. In this way, rolling and coiling of the conductor are performed simultaneously to produce a coil.

9 Claims, 5 Drawing Sheets

METHOD FOR MANUFACTURING COIL

BACKGROUND OF THE INVENTION

1. Field of the Invention

The present invention relates to a method for manufacturing a coil formed of a conductor of rectangular cross section and used in an electric apparatus such as a motor or a transformer.

2. Description of the Related Art

Conventionally, a conductor of rectangular cross section is wound as it is to obtain a coil.

This method involves the formation of a projection, such as a thick-walled portion or a deformed portion, at the inner side of a coiled conductor. Since such a projection may cause dielectric breakdown or a like failure, the projection is made smooth by use of a coil surface leveler as disclosed in, for example, Japanese Patent Application Laid-Open (kokai) No. 57 (1982)-68222.

However, the conventional method for manufacturing a coil involves the following drawbacks.

First, since a separate surface leveler is required, the number of manufacturing apparatuses and the number of production steps increases, with the result that the cost of manufacture increases, and productivity decreases.

Second, projections projecting in the axial direction of a coil can be eliminated, but other projections projecting toward the center of the coil may be newly generated, and deformed portions cannot be completely eliminated, thus resulting in failure to obtain a coil of high quality and excellent homogeneity.

SUMMARY OF THE INVENTION

An object of the present invention is to provide a method for manufacturing a coil which does not require employment of a separate surface leveler, thereby reducing production cost through decrease in the number of manufacturing apparatuses and the number of production steps, and which can improve productivity.

Another object of the present invention is to provide a method for manufacturing a coil which does not involve the formation of a projection, such as a thick-walled portion or a deformed portion, on the coil, thereby obtaining a coil of high quality and excellent homogeneity.

Still another object of the present invention is to provide a method for manufacturing a coil which can reduce the size of the coil and which can suppress bubble formation within ceramics to thereby establish good insulation.

Yet another object of the present invention is to provide a method for manufacturing a coil which establishes reliable adhesion (a reliable bond) between ceramics and a conductor and which establishes an appropriate difference in thermal expansion between coating layers, thereby imparting significantly high mechanical rigidity to the coil.

To achieve the above objects, the present invention provides a method for manufacturing a coil comprising the step of rolling a conductor of trapezoidal cross section or a conductor of rectangular cross section in the longitudinal direction thereof. At this time, an amount of deformation is gradually increased from a side of the conductor corresponding to the inner side of the coil toward a side of the conductor corresponding to the outer side of the coil. As a result, the conductor of trapezoidal cross section is formed into a coiled conductor of rectangular cross section, or the conductor of rectangular cross section is formed into a coiled conductor of trapezoidal cross section. In this way, rolling and coiling of the conductor are performed simultaneously to produce a coil.

DETAILED DESCRIPTION OF THE PREFERRED EMBODIMENT

Embodiments of the present invention will next be described with reference to the drawings. The accompanying drawings are illustrative of the embodiments and are not meant to limit the scope of the invention. To clarify the invention, detailed description of known parts is omitted.

Figure 2:
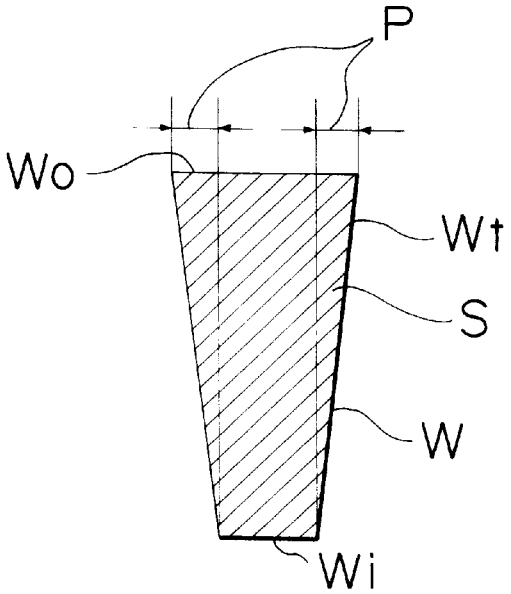
FIG. 2 is a sectional view showing the conductor of trapezoidal cross section used in the method of the embodiment.

A copper conductor Wt (W) of trapezoidal cross section as shown in FIG. 2 is prepared. The conductor Wt of trapezoidal cross section is uncoated and has a cross-sectional area of about 10 $mm^2$.

Figure 1:
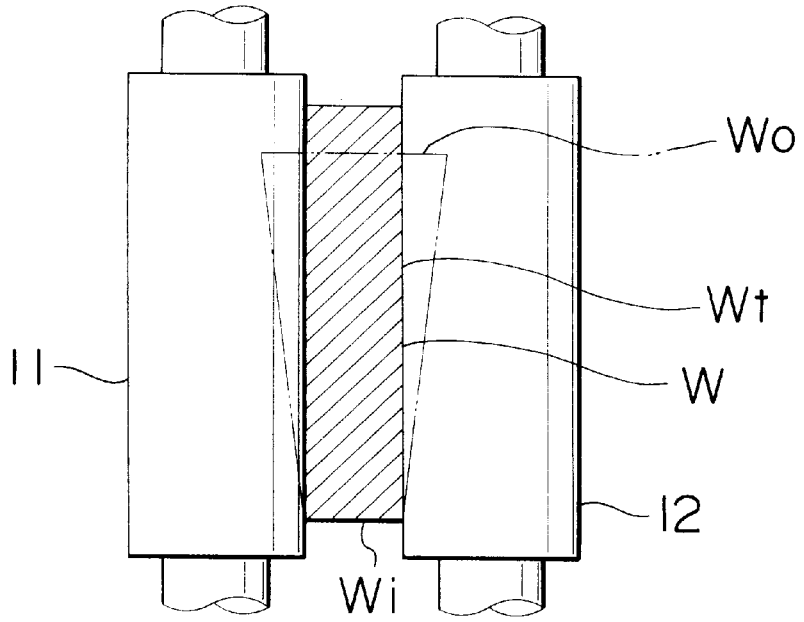
FIG. 1 is a partial sectional front view showing the rolling of a conductor of trapezoidal cross section by a method for manufacturing a coil according to an embodiment of the present invention.

In FIG. 1, reference numerals 11 and 12 denote a pair of rollers. The rollers 11 and 12 each have a cylindrical shape and are arranged in parallel to each other with a predetermined gap provided therebetween.

Figure 3:
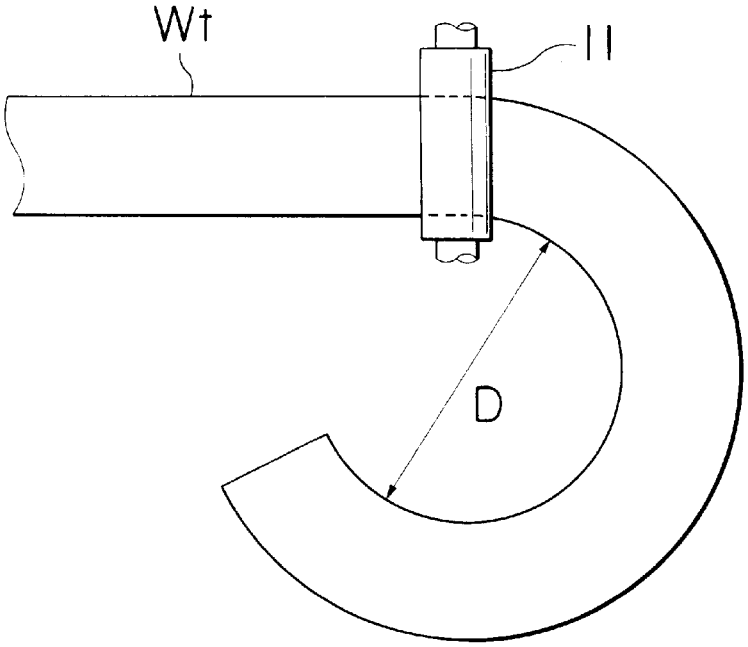
FIG. 3 is a side view showing how the conductor of trapezoidal cross section is rolled and wound by the method of the embodiment.

In manufacture of a coil, as shown in FIGS. 1 and 3, the conductor Wt of trapezoidal cross section is caused to pass between the rollers 11 and 12. As a result, the conductor Wt of trapezoidal cross section is rolled in the longitudinal direction thereof. The conductor Wt of trapezoidal cross section is rolled into the conductor Wt of rectangular cross section as shown in FIG. 1. The short side of the rectangular cross section has a length equal to the gap between the rollers 11 and 12.

Figure 4:
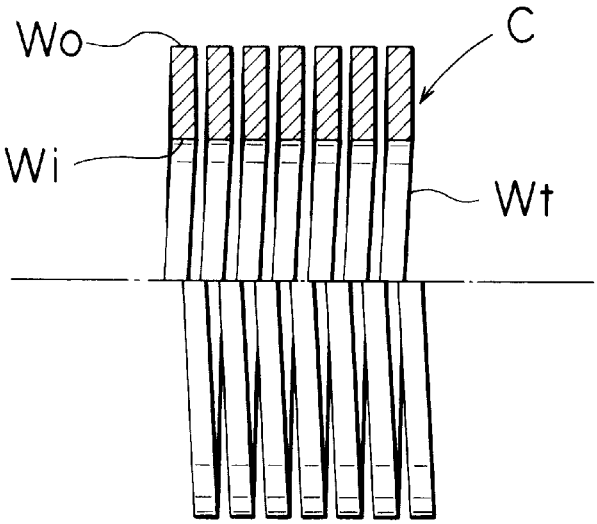
FIG. 4 is a half sectional view showing a coil manufactured by the method of the embodiment.

In this case, an amount P of deformation is gradually increased from a side Wi of the conductor Wt of trapezoidal cross section corresponding to the inner side of a coil toward a side Wo of the conductor Wt of trapezoidal cross section corresponding to the outer side of the coil. As a result of the difference in the amount P of deformation between the sides Wi and Wo, the conductor Wt of rectangular cross section ejected from between the rollers 11 and 12 is coiled into a circular coil C as shown in FIG. 3. In order to manufacture the coil C of a desired inner diameter D, the shape of the trapezoidal cross section of the conductor Wt and the amount P of deformation are determined accordingly. FIG. 4 shows the manufactured coil C.

The thus-obtained coil C is subjected to insulation treatment to impart a desired dielectric strength thereto. The insulation treatment will next be specifically described with reference to FIGS. 5 to 7.

The opposite ends of the coil C are pulled axially to thereby expand the coil C, i.e., expand the gap between the adjacent turns of the conductor Wt of rectangular cross section. The expanded coil C undergoes surface treatment, whereby a prime layer Lx is formed on the surface thereof. Nickel plating or chromium plating is an excellent surface treatment for the copper conductor Wt of rectangular cross section. In this case, plating is limited to a minimally required thickness so as to minimize magnetic effect.

Notably, the prime layer Lx is employed for the following reason. Since the firing temperature for ceramics is usually 200° C. or higher, the surface of the copper conductor Wt of rectangular cross section is oxidized, resulting in a weakened bond between the conductor surface and ceramics. Also, since the thermal expansion coefficient of copper is a bout three times that of ceramics, thermal shrinkage may cause ceramics to separate from the conductor. Surface treatment, such as plating treatment or oxidation treatment, of the conductor Wt of rectangular cross section facilitates intimate contact between the conductor surface and ceramics.

Then, two ceramics layers La and Lb are sequentially formed on the prime layer Lx.

Specifically, the first ceramics layer La is formed by the steps of: applying liquid ceramics onto the prime layer Lx; and firing the applied ceramics at high temperature. The liquid ceramics may be applied by dipping the coil C into the liquid ceramics or by spraying the liquid ceramics onto the coil C. In order to obtain a target thickness of coat, carrying out several repetitions of coating is effective. Particularly, forming thin layers of coat one on the other brings about a ceramics layer of good quality with no bubbles contained therein.

Next, in order to form the second ceramics layer Lb, liquid ceramics is applied onto the first ceramics layer La. Since the second ceramics layer Lb is the last layer to be formed, after application of the liquid ceramics, the coil C is released from expansion and is allowed to shrink to its natural state. Then, the applied ceramics is fired to form the second ceramics layer Lb. Notably, through adjustment of the viscosity of the liquid ceramics, the ceramics layers La and Lb can be finished to their respective target thicknesses.

Figure 5:
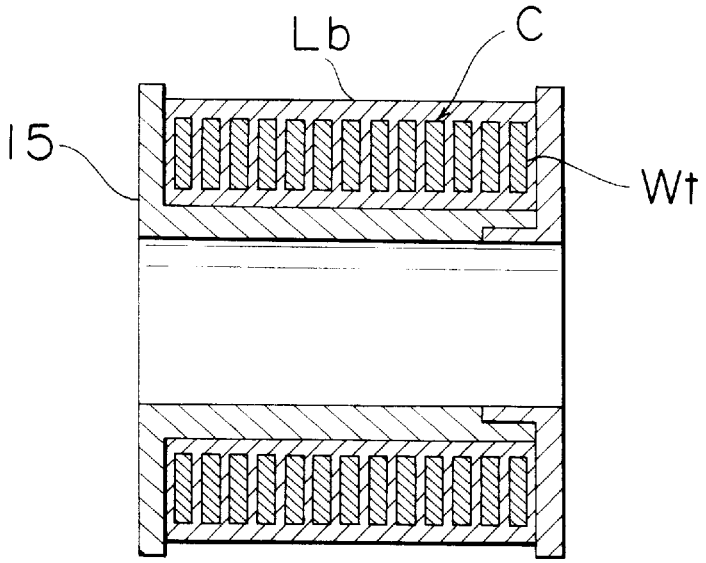
FIG. 5 is a longitudinal sectional view showing the coil of FIG. 4 attached onto a coil bobbin.
Figure 6:
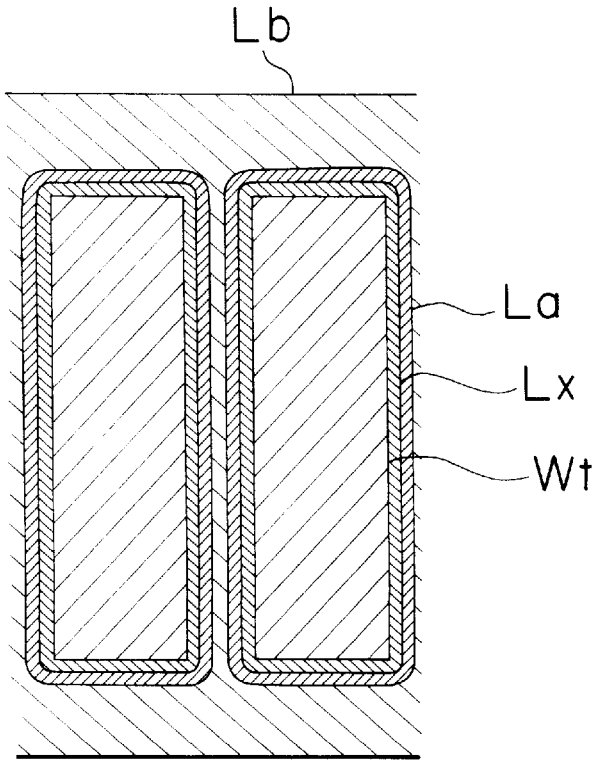
FIG. 6 is an enlarged view showing a portion of FIG. 5.

Thus, the coil C insulated with ceramics is obtained. The coil C can serve as a final product as is. Alternatively, as shown in FIG. 5, the coil C may be attached to a coil bobbin 15. In this case, the coil bobbin 15 is formed through assembly of divided members. After the coil C is attached to the coil bobbin 15, ceramics or a like material may be filled into the gap between the coil C and the coil bobbin 15 as needed.

Usually, ceramics is used as an electrical insulating material that can endure a working temperature greater than 250° C. Generally, in manufacture of a coil insulated with ceramics, a ceramics-insulated conductor is coiled, or after an uninsulated conductor is coiled, ceramics is filled into gaps between turns of the coiled conductor.

However, in the case of the method in which a ceramics-insulated conductor is coiled, since the ceramics-insulated conductor is difficult to elongate or bend, a coiling process encounters poor workability of the conductor. Examples of poor workability include the following: back tension during coiling is limited; and the ceramics-insulated conductor cannot be bent at an acute angle. Accordingly, the final shape of a coil is limited. Meanwhile, the method in which ceramics is filled into gaps between turns of a coiled conductor is particularly applied to the case where a coil is formed of a thick conductor and assumes a small size. According to this method, after an uncoated conductor is coiled, ceramics is filled into gaps between turns of the coiled conductor. Thus, the gaps must be of a certain magnitude, resulting in an increase in coil size. If the gap is too small, ceramics may separate from the conductor, whose material is primarily copper, due to the difference in thermal expansion coefficient therebetween. Therefore, the gaps cannot be decreased.

According to the present embodiment, not only can ceramics impart sufficient insulation property and heat resistance to the coil C, but also a very thin insulation layer can be formed. Thus, the size of the coil C can be reduced, and bubble formation within ceramics can be suppressed to thereby establish good insulation. Also, reliable adhesion (a reliable bond) can be established between ceramics and a conductor, and an appropriate difference in thermal expansion coefficient can be established between coating layers, thereby imparting significantly high mechanical rigidity to the coil C.

Figure 7:
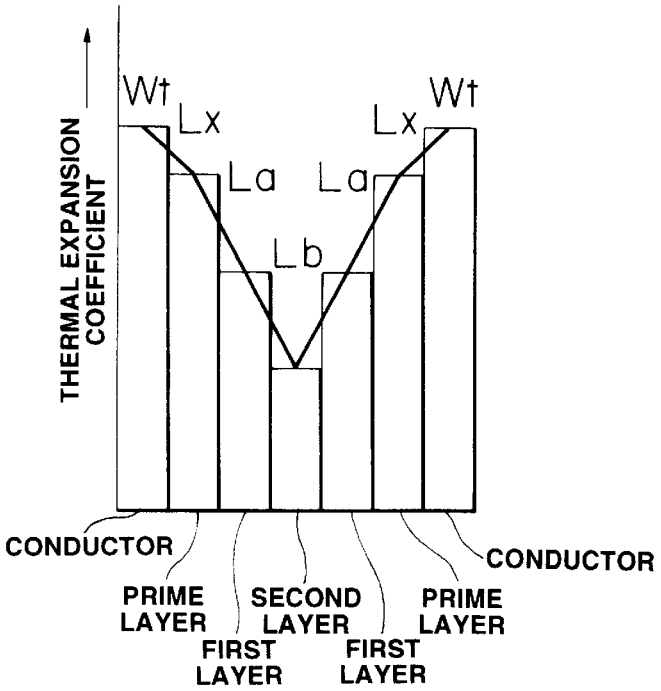
FIG. 7 is a characteristic diagram showing a change in thermal expansion coefficient between adjacent turns of the conductor of rectangular cross section of the coil of FIG. 4.
Figure 8:
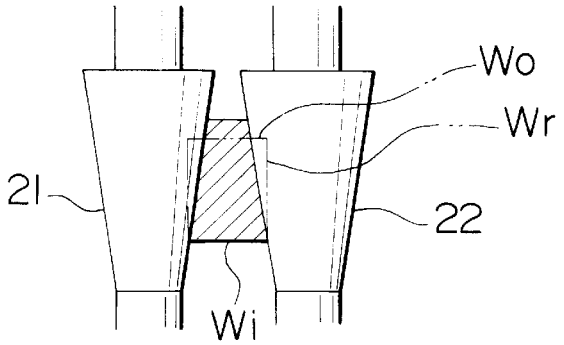
FIG. 8 is a partial sectional front view showing the rolling of a conductor of rectangular cross section by a method for manufacturing a coil according to a modified embodiment of the present invention.
Figure 9:
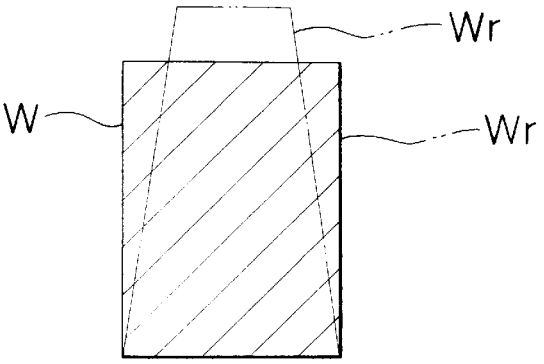
FIG. 9 is a sectional view showing the conductor of rectangular cross section used in the method of the modified embodiment.

FIG. 7 shows a change in thermal expansion coefficient between adjacent turns of the conductor Wt of rectangular cross section of the coil C manufactured by the method of the present embodiment. As shown in FIG. 7, the change in thermal expansion coefficient is gentle, so that the separation of the insulation layer from the conductor can be prevented. The effect of the difference in thermal expansion coefficient on the adhesion of the insulation layer can be checked by subjecting the coil C to heat shock. When the coil C is subjected to heat shock, the insulation layer may separate from the conductor due to the difference in thermal expansion coefficient therebetween unless appropriate measures are taken. In the coil C manufactured by the method of the present embodiment, the prime layer Lx and the ceramics layers La and Lb establish a gentle change in thermal expansion coefficient between adjacent turns of the coil C, thereby buffering heat shock.

FIGS. 8 to 11 show modified embodiments of the method. According to the modified embodiment of FIGS. 8 and 9, a conductor W of rectangular cross section (a conductor Wr) is rolled into a coiled conductor of trapezoidal cross section. This method is similar to that of the basic embodiment described previously except that conical (tapered) rollers 21 and 22 are used, and has the advantage that general conductors of rectangular cross section can be used.

Figure 10:
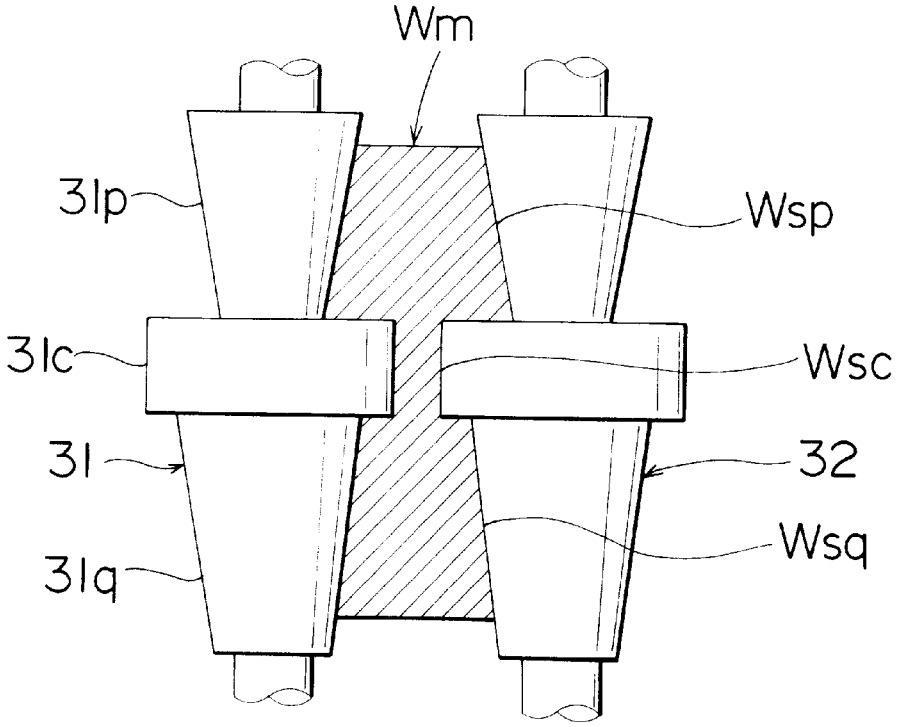
FIG. 10 is a partial sectional front view showing the rolling of a conductor of rectangular cross section by a method for manufacturing a coil according to another modified embodiment of the present invention.
Figure 11:
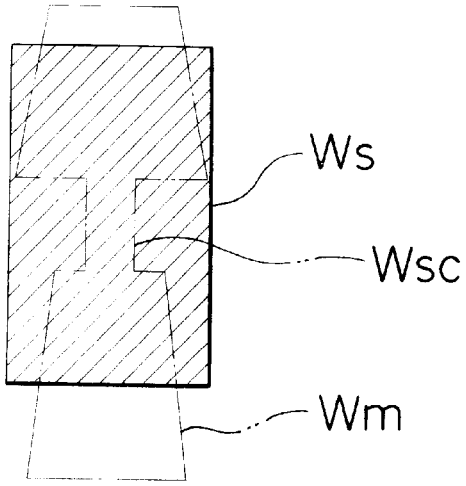
FIG. 11 is a sectional view showing the conductor of rectangular cross section used in the method of the another modified embodiment.

According to the modified embodiment of FIGS. 10 and 11, a conductor W of rectangular cross section (a conductor Ws) is rolled into a coiled multilayer conductor Wm, which includes a plurality of conductor portions Wsp and Wsq of trapezoidal cross section integrated together by corresponding narrower connection portions Wsc. This method employs a pair of rollers 31 and 32 as shown in FIG. 10. The rolling roller 31 (32) includes a first roller portion 31*p*, an intermediate roller portion 31*c* for forming the connection portion Wsc, and a second roller portion 31*q*, which portions are sequentially formed in the axial direction thereof. This method is similar to that of the basic embodiment described previously. According to the present modified embodiment, the conductor portions Wsp and Wsq of trapezoidal cross section are formed substantially independent of each other. Thus, even when the conductor Ws of rectangular cross section has an elongated rectangular cross section, the respective rectangular conductor portions Wsp . . . can be rolled independently, so that the conductor Ws of rectangular cross section can be wound readily and smoothly, and the formed coil C is almost of a true circle. Further, since ceramics enters into grooves formed around the corresponding connection portions Wsc, the coil C assumes higher rigidity. For a certain shape of a coil to be manufactured, the connection portions Wsc may be previously formed on the conductor Ws of rectangular cross section.

The present invention is not limited to the above-described embodiments. Regarding structural details, techniques, and the like, modifications and any omission or addition may be possible as needed without departing from the scope of the invention.

What is claimed is:

1. A method for manufacturing a coil, in which a conductor of trapezoidal cross section is rolled in the longitudinal direction thereof thereby causing deformation of said conductor such that the amount of deformation is gradually increased from a side of the conductor of trapezoidal cross section corresponding to the inner side of a coil to be formed toward a side of the conductor of trapezoidal cross section corresponding to the outer side of the coil to be formed, so that the conductor of trapezoidal cross section is formed into a coiled conductor of rectangular cross section through simultaneous rolling and coiling of the conductor and the coiling of the conductor is achieved by forces generated during the rolling operation.

2. The method for manufacturing a coil according to claim 1, wherein the conductor of rectangular cross section is rolled into a coiled multilayer conductor having a plurality of conductor portions of trapezoidal cross section integrated together by a narrower connection portion disposed between each pair of said plurality of conductor portions.

3. The method for manufacturing a coil according to claim 1, wherein the coiled conductor is subjected to surface treatment to form a prime layer on the surface of the coiled conductor, and a plurality of ceramics layers are sequentially formed on the prime layer.

4. The method for manufacturing a coil according to claim 3, wherein the conductor is formed of copper and is plated with nickel or chromium as the surface treatment.

5. The method for manufacturing a coil according to claim 4, wherein the plurality of ceramics layers are formed by repeating application of liquid ceramics and subsequent firing.

6. A method for manufacturing a coil, in which a conductor of rectangular cross section is rolled in the longitudinal direction thereof thereby causing deformation of said conductor such that the amount of deformation is gradually increased from a side of the conductor of rectangular cross section corresponding to the inner side of a coil to be formed toward a side of the conductor of rectangular cross section corresponding to the outer side of the coil to be formed, so that the conductor of rectangular cross section is formed into a coiled conductor of trapezoidal cross section through simultaneous rolling and coiling of the conductor and the coiling of the conductor is achieved by forces generated during the rolling operation.

7. The method for manufacturing a coil according to claim 6, wherein the coiled conductor is subjected to surface treatment to form a prime layer on the surface of the coiled conductor, and a plurality of ceramics layers are sequentially formed on the prime layer.

8. The method for manufacturing a coil according to claim 7, wherein the conductor is formed of copper and is plated with nickel or chromium as the surface treatment.

9. The method for manufacturing a coil according to claim 8, wherein the plurality of ceramics layers are formed by repeating application of liquid ceramics and subsequent firing.

* * * * *